United States Patent [19]

Bulkens

[11] Patent Number: 4,907,710

[45] Date of Patent: Mar. 13, 1990

[54] TRASH CAN WITH INTEGRAL DUSTPAN FOR UTILIZATION OF PLASTIC LINERS WITH HANDLES

[76] Inventor: Catherine S. Bulkens, 937 Tom Smith Rd., Lilburn, Ga. 30247

[21] Appl. No.: 156,403

[22] Filed: Feb. 16, 1988

[51] Int. Cl.[4] ..... B65D 90/00; A63B 55/04

[52] U.S. Cl. ..... 220/1 T; 220/212; 220/404; 248/97

[58] Field of Search ..... 220/1 T, 403, 404, 23.86, 220/212, 407; 248/99-101, 97; 383/33

[56] References Cited

U.S. PATENT DOCUMENTS

| | | | |
|---|---|---|---|
| 1,044,306 | 11/1912 | Vertner | 220/1 T X |
| 2,549,572 | 4/1951 | Campanelli | 220/212 |
| 3,156,941 | 11/1964 | Tomaiuolo | 220/1 T X |
| 4,366,916 | 1/1983 | Guido et al. | 220/404 |
| 4,600,113 | 7/1986 | De Mars | 220/1 T |
| 4,649,813 | 3/1987 | Kehl | 220/1 T X |
| 4,664,347 | 5/1987 | Brown et al. | 220/404 X |
| 4,697,771 | 10/1987 | Majors | 248/97 |

FOREIGN PATENT DOCUMENTS

| | | | |
|---|---|---|---|
| 682465 | 3/1964 | Canada | 220/1 T |
| 138780 | 4/1985 | European Pat. Off. | 220/1 T |

*Primary Examiner*—Harvey C. Hornsby
*Assistant Examiner*—Stephen F. Gerrity
*Attorney, Agent, or Firm*—James A. Hinkle

[57] ABSTRACT

An inexpensive trash can for normal household kitchen trash designed to hold thin wall plastic bags which are normally given to the customer in grocery and like retail stores. The trash can has upstanding handle support flanges which project upwardly from opposing side walls of the trash can and which terminate in a projecting lip to hold the handles of the plastic bag and to maintain the bag in an open condition. A dustpan, which doubles as a top cover for the trash can, comes as an integral part of the trash can.

2 Claims, 2 Drawing Sheets

TRASH CAN WITH INTEGRAL DUSTPAN FOR UTILIZATION OF PLASTIC LINERS WITH HANDLES

BACKGROUND OF THE INVENTION

I. Field of the Invention

The present invention relates generally to the reuse of plastic bags, of the type which are currently provided by commercial stores to hold customer goods. Such bags generally have a top opening and two handles to allow the plastic bags (after being loaded at the store) to be grasped by the handles and transported by the customer. The present invention also has an integral lid which will provide the user a dustpan that is conveniently located and stored.

II. Description of the Prior Art

At one time, it was common in retail stores for customer goods to be bagged for transportation to the customer's home in paper sacks made of kraft paper. Once the goods had been transported home, the customer frequently utilized the stiff kraft paper bags as a trash can liner in a kitchen environment. These bags were so sized that they quite readily fit into an upright, rectangular trash can and provided the customer with a convenient way of disposing of household trash.

At a point in time, a standard type of plastic trash can liner was also made available to customers and was sized to fit a convenient range of can sizes. Normally, these liners were sized so that they were sufficiently tall to fit into the trash can and rest against the bottom of the can. They could then be adapted to be folded over the top of the can in order to support the limp side walls of the plastic liner.

In recent years, however, many commercial stores (especially grocery stores) have switched from paper bags for holding customer goods to a limp, plastic film bag which does not have side walls of such stiffness to allow the bags to be self-standing. These bags have grown in acceptance and many customers have attempted to utilize these bags in a kitchen trash can. They have been thwarted in their attempted use, however, because the typical trash can was not designed to hold the new type of plastic grocery bags without some sort of supporting structure. The typical plastic grocery bag has a pair of handles made integrally with the top of the bag for ease of carrying the bag from the store to the customer's home. The loops of the handles, however, are not adapted to fit any kind of typical trash can so as to hold the plastic trash bag in the trash can and maintain it in an open, upright stance to receive typical household trash.

A number of metal and plastic frame-type supporting structures have come into being which are designed to hold the new type of plastic grocery bags, but these have not gained popular acceptance by the customer. Typically, these frame supports tend to be awkward and unstable, they do not hold the bag well, and they tend to collapse and fall apart while in use. Other inventors have designed supporting hooks and members to be utilized with a typical trash can, but these require the customer to retrofit the supports to the trash can. These items also have not gained wide acceptance by the consumer.

SUMMARY OF THE INVENTION

It is therefore an object of the present invention to provide a supporting system for thin-wall plastic bags for use in a conventional type of trash container, that is readily adaptable and easily applied to support the plastic bag.

Another object of the invention, is the provision of a trash basket which can hold a plastic grocery bag in an open position and which is of simple, reliable and economical construction; yet, which is designed to gain immediate consumer acceptance.

Yet another object of the invention, is to provide a household trash can for use with grocery store-type plastic bags having a pair of handles which may be utilized to support the bag within the trash container; and wherein the trash container has an integral dustpan, which acts as a lid to the trash can and at the desire of the consumer, may be utilized as a dustpan.

Another object of the invention, is to provide a unitary kitchen-type trash can having a unitary dustpan which may be alternately used as a dustpan or a lid for the trash can; and wherein the unique combination may be utilized with a household plastic bag (given free by grocery stores and other retail establishments when customer goods are packed for transportation from such stores).

Other objects, advantages and capabilities of the invention will become apparent from the following description when taken in conjunction with the accompanying drawings, showing only a preferred embodiment of the invention.

DESCRIPTION OF THE PREFERRED EMBODIMENT

Figure 1:
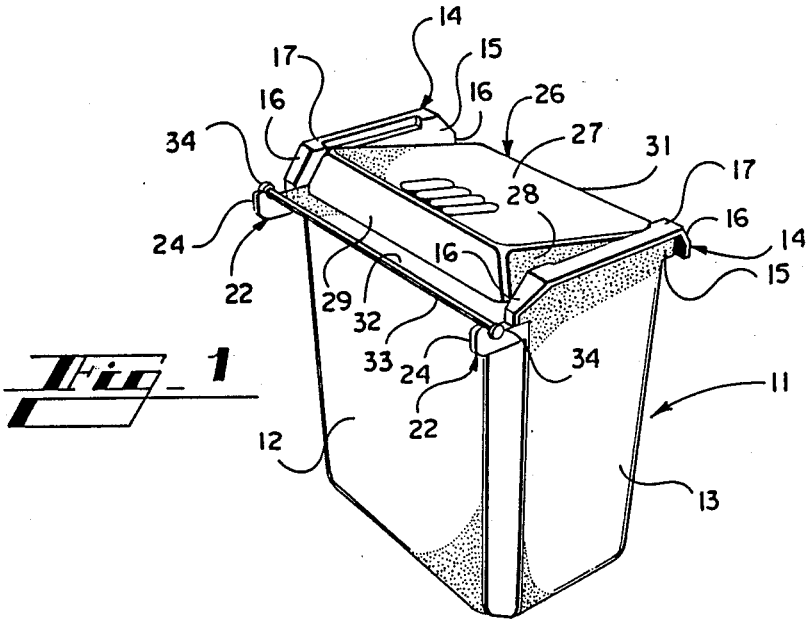
FIG. 1 is a perspective view of the combination trash can and dustpan showing the dustpan acting as a lid in a closed position.

Referring to the drawings wherein like reference numerals designate corresponding parts throughout the several figures, the trash container is indicated by numeral 11. The trash container 11 may be made of a rigid, plastic material or some other suitable material; and in the preferred embodiment, the container is designed in a shape generally similar to an inverted frustum of a rectangular pyramid having side walls 12 and end walls 13. At the upper end of the trash container 11, the end walls 13 terminate in a combination container lifting handle and bag handle engaging means 14. Attached to the end walls 13, is a handle-support flange 15 which projects vertically above the end walls. The opposing side walls 16 of the handle-support flange 15 are inclined toward one another and then, in a truncated manner terminate in a protruding lip 17.

The handle means 14 has a lifting capability for ease of lifting the trash container and a bag support capability for maintaining the trash bag around the handles. These capabilities are built into the handle engaging means 14. This may be seen by the fact that the inclined sides 16 and the protruding lip 17 project outwardly from the trash container and away from the handle-support flange 15. Therefore, the underside of the protruding lip 17 gives the user a firm grasping surface for lifting the trash container.

Figure 5:
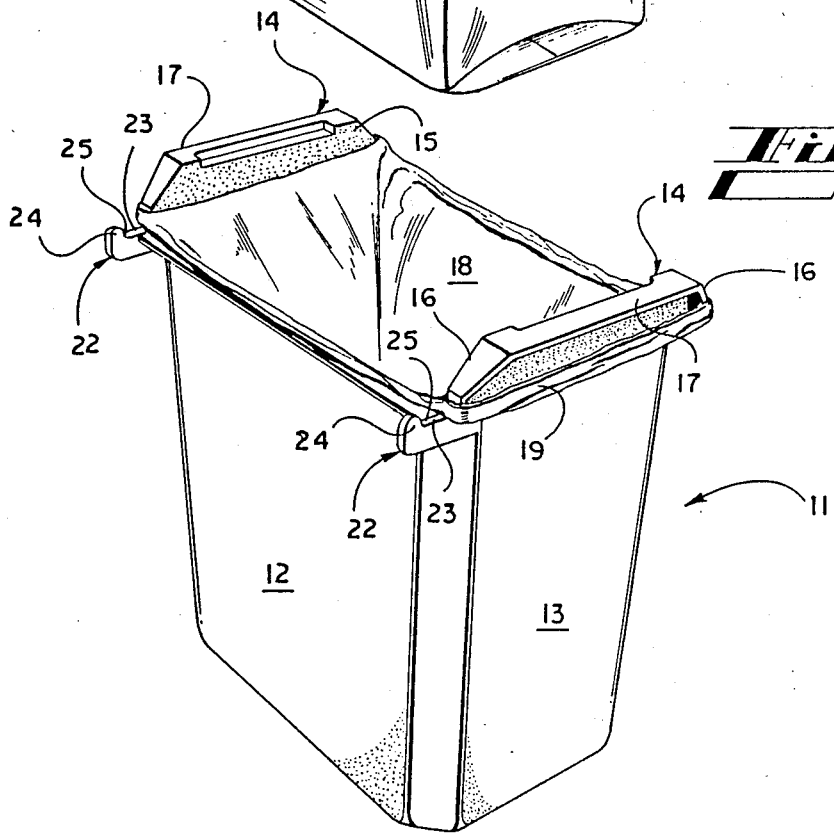

When the typical flexible trash bag 18 is placed within the trash container, the handles 19 of the bag are placed around the respective handle engaging means 14 by placing the handle apertures 21 over the engaging means 14 and pressing the excess material together to form a thin strip around the contact areas 14*a* as is shown in FIG. 5. Typically, the type of bag 18 utilized, has a certain capability of allowing the bag handles to stretch a sufficient amount to tightly engage the contact areas 14*a*.

The bag 18 is then maintained on the trash container in its operative relation by a combination of a friction fit around the contact areas 14*a* and due to the fact that the handle means 14 project outwardly from the handle-support flange 15 at a greater distance at the top of the handle means 14 then at the bottom of said means where the handle means connects to the trash container.

Integrally connected to the opposing sides of the one of the side walls 12 of the trash container and at its uppermost portion where said side wall connects to the the handle engaging means 14, are dustpan support and pivot means 22. The pivot means 22 is generally defined by a projecting member which forms a pivot surface 23 and which terminates in an upturned tab 24. It is anticipated that during manufacture of the trash container, the pivot means 22 will be integrally molded into the side and end walls of each container to form a unitary structure. As can be seen at the juncture of the pivot surface 23 and the upstanding tab 24, there is a rounded radius which will act as a pivot radius 25 for the dustpan.

Figure 2:
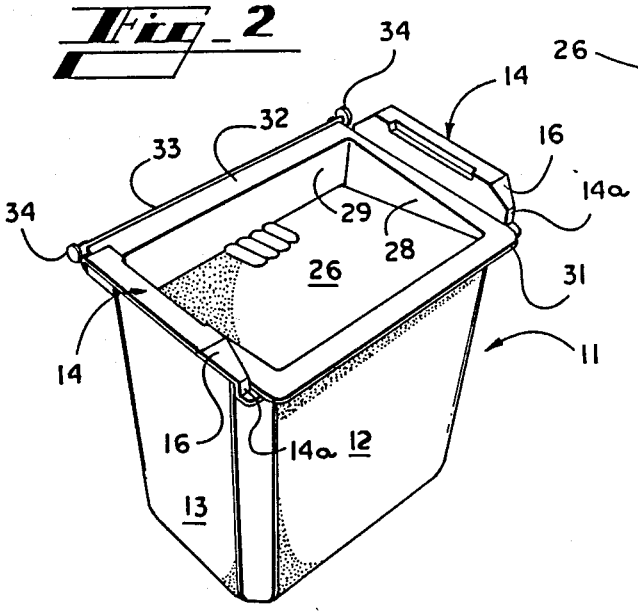
FIG. 2 is a perspective view showing the dustpan flipped over and acting as a lid in its alternate position.
Figure 3:
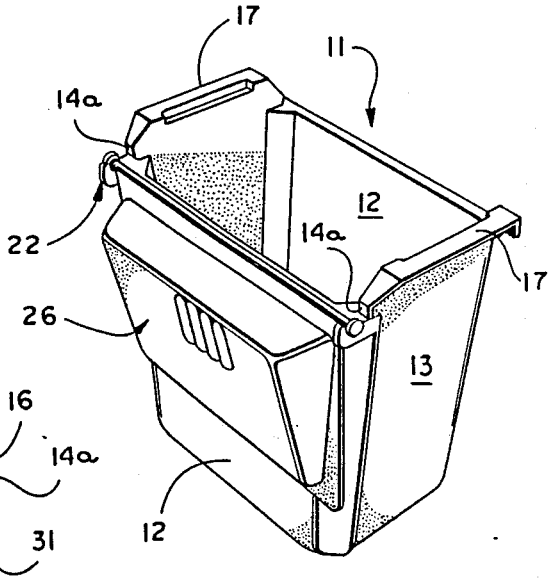
FIG. 3 is a perspective view showing the dustpan/lid combination in an open position, allowing utilization of the trash can while the lid is maintained in an opened position by the associated hinge system for the lid.
Figure 4:
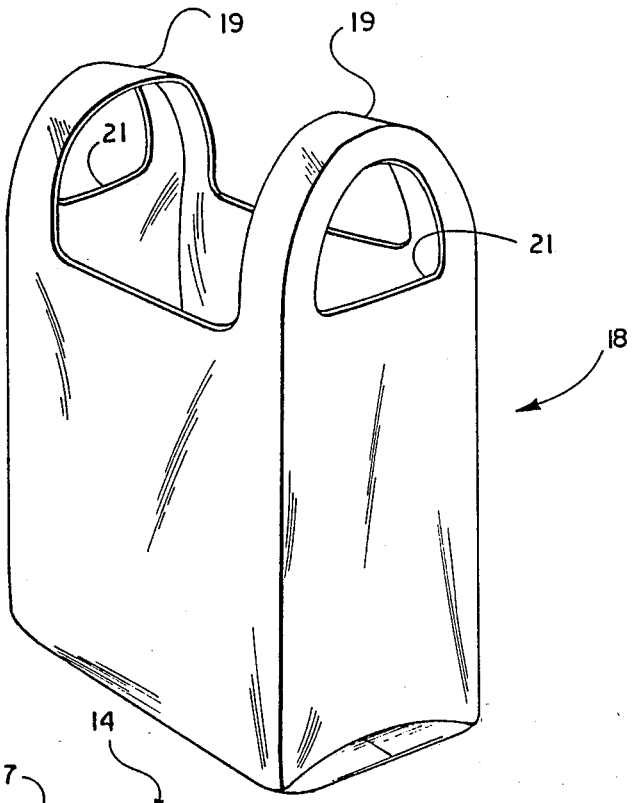
FIG. 4 shows the construction of a typical thin wall, plastic grocery bag which may be utilized in the present invention; and, FIG. 5 shows the trash can of the present invention with the lid removed and with the typical plastic bag being supported in operative relation by the handle means of the trash can.

An important feature of the present invention, is the provision of a unitary dustpan to be manufactured with the present trash container 11. The dustpan performs two functions with the present invention: one being its normal use as a dustpan, and the other as a lid for the trash container. A problem which the consumer finds with dustpans, is that when one is needed, it is always difficult to locate one. In the present invention, however, with the dustpan forming an integral aspect of the trash container, one will find that the dustpan is in its logical place—near the container in which the trash will be placed after being swept up. Therefore, as can be seen in FIGS. 1, 2 and 3, the dustpan 26 of the present invention is shown in its various operative positions.

The dustpan 26 is defined by a pan bottom 27, a pair of opposed pan side walls 28 and a pan end wall 29; all joined to form a structure which is suitably adapted to be placed in engagement with a floor to have dust and debris swept into the pan over the floor engaging lip 31 by the ultimate user. Projecting from the pan end wall 29, is a pivot-bar flange 32 which terminates in a pivot bar 33. The pivot bar may be of any suitable shape in the area where it attaches to the flange 32. At its opposed ends, however, it should be of a circular configuration inasmuch as this is the portion which will engage the radius surface 25 of the dustpan pivot means 22. At the opposed ends of the pivot bar, end stops 34 are located. These are merely enlargements at the ends of the pivot bar for the purpose of maintaining the dustpan in engagement with the pivot means 22 when raised and lowered.

In FIG. 1, the dustpan is shown wherein the pan bottom 27 is so positioned that the lid forms a inclined surface with respect to the trash can top. In FIG. 2, the reverse position of the dustpan is shown wherein the dustpan is flipped over so that the pan bottom 27 projects into the trash can rather than out of the trash can (as seen in FIG. 1). The positioning of the dustpan is really a user preference although (as shown in FIG. 2) it does allow the customer to deposit debris and/or items into the dustpan for future disposal. This would not be possible in the positioning of the dustpan as shown in FIG. 1. To maintain the trash can container in its open operative position, the dustpan may be hinged to hang fully downward into a position which it is out of the way, at all times (as is shown in FIG. 3). For clarity purposes, the trash bag 18 has not shown been shown in FIGS. 1, 2 and 3. It should be noted, however, that the trash bag is designed to be utilized with the dustpan in its operative position and poses no problem in moving the dustpan from an open or closed position when the trash bag is in place.

Various modifications may be made of the invention without departing from the scope thereof and it is desired, therefore, that only such limitations shall be placed thereon as are imposed by the prior art and which are set forth in the appended claims.

What is claimed is:

1. A trash container adapted to support a flexible, non self-supporting, thin-walled, plastic bag within the container, wherein the bag has an open end flanked by a pair of flexible handles, each of which have a receiving aperture therein, the handles further being designed to attach to the container and maintain the plastic bag in an open condition and to substantially fill the container, the improvement comprising:

the container having a bottom panel and a pair of opposed upstanding side walls and a pair of opposed end walls, the side walls and end walls each having a proximal end and a distal end, the side walls and end walls being connected to one another to form a peripheral container wall and being connected to the bottom panel at the proximal end of each of said side walls and end walls, said distal ends of the side walls and end walls defining an upper opening for the container, a peripheral edge being defined by the termination of said peripheral wall at the distal ends of said side walls and end walls, first and second bag handle engaging means integral with the peripheral edge of respective opposed end walls, each handle engaging means projecting upwardly from the container opening in a plane parallel to the end wall adjacent to the respective handle engaging means and having a handle support flange attached to the peripheral edge of said respective opposing end wall, lifting means attached to respective support flanges and projecting outwardly from and perpendicularly to the plane of each respective end wall, each lifting means comprising a protruding lip having opposed ends and lying substantially parallel to the peripheral edge of the upper opening of the container, the lifting means terminating at said opposed ends in a downward incline to a point at a predetermined distance from the peripheral edge of the perspective end wall, wherein said predetermined distance defines a bag handle contact area adapted to receive a respective plastic bag handle therearound, a removable top cover which can be pivoted between a first position covering said upper opening of said container and a second position uncovering said upper opening of said container, said cover fitted to said container wherein said top cover defines a dustpan having a bottom with a free edge, two opposed side walls attached to the pan bottom, an end wall attached to each pan side wall and to the pan bottom, both of said side walls and the end wall having a free edge, said free edge of the end wall, the free edge of each of the side walls and the bottom free edge defining a peripheral edge, and a flange attached to said peripheral edge projecting outwardly from the dustpan, and support pivot means, adapted to support the removable top cover, projecting from said opposed end walls of the trash container, said support pivot means comprising a pair of elongated tabs, each tab having a pivot surface and an upwardly extending tab portion, said pivot surface and tab portion permitting said top cover to be removable for use and retaining said cover when pivoted between said first and second positions.

2. The trash container as claimed in claim 1, wherein a pivot bar is attached to one side of the peripheral flange of said top cover with the pivot bar having a sufficient length to overlie said support pivot bar means thereby providing a pivoting hinge about which the top cover may rotate.

* * * * *